United States Patent [19]

Hata et al.

[11] Patent Number: 5,013,523

[45] Date of Patent: May 7, 1991

[54] METAL-BASED COMPOSITE MATERIAL AND PROCESS FOR PREPARATION THEREOF

[75] Inventors: Hajime Hata, Marugame; Takao Kitamura, Takamatsu; Kohji Sakane, Takamatsu; Hideo Wada, Takamatsu; Seiji Sogabe, Marugame, all of Japan

[73] Assignees: Agency of Industrial Science & Technology, Tokyo; Shikoku Chemicals Corporation, Kagawa, both of Japan

[21] Appl. No.: 510,445

[22] Filed: Apr. 18, 1990

[30] Foreign Application Priority Data

Apr. 21, 1989 [JP] Japan ..... 1-99941
Sep. 18, 1989 [JP] Japan ..... 1-242949

[51] Int. Cl.[5] ..... C22C 1/09; C22C 21/00

[52] U.S. Cl. ..... 419/19; 428/614; 419/24

[58] Field of Search ..... 428/614; 419/19, 24

[56] References Cited

U.S. PATENT DOCUMENTS

| | | | |
|---|---|---|---|
| 3,795,524 | 3/1974 | Sowman | 501/95 |
| 4,510,253 | 4/1985 | Felice et al. | 501/133 |
| 4,522,926 | 6/1985 | Felice | 501/127 |
| 4,789,422 | 12/1988 | Misra | 423/278 |
| 4,806,509 | 2/1989 | Porterfield | 501/133 |
| 4,857,489 | 8/1989 | Bearden | 501/36 |

FOREIGN PATENT DOCUMENTS 0296779 12/1988 European Pat. Off. .

*Primary Examiner*—R. Dean
*Assistant Examiner*—David W. Schumaker
*Attorney, Agent, or Firm*—Sherman and Shalloway

[57] ABSTRACT

Disclosed is a metal-based composite material comprising aluminum or an aluminum alloy combined with a whisker of aluminum borate represented by the chemical formula of $9Al_2O_3.2B_2O_3$ or $2Al_2O_3.B_2O_3$. This composite material has excellent mechanical properties such as high tensile strength and high hardness.

2 Claims, No Drawings

METAL-BASED COMPOSITE MATERIAL AND PROCESS FOR PREPARATION THEREOF

BACKGROUND OF THE INVENTION (1. ) Field of the Invention

The present invention relates to an aluminum type metal-based composite material comprising an aluminum borate whisker as a reinforcer, and a process for the preparation thereof.

(2) Description of the Related Art

With recent technical development in various industries represented by the aerospace industry, the demand for a new material having higher strength, elasticity and hardness and capable of resisting a higher temperature than conventional metal materials is increasing.

Among metal materials, aluminum and aluminum alloys have a low specific gravity and an easy workability and are supplied at low costs, and therefore, they are widely used as materials having high strength and heat resistance in various fields for airplanes, automobiles, construction materials, chemical machines and the like.

As the means for improving the mechanical properties of aluminum type metals, there have been vigorously investigated methods of forming composite materials by combining an aluminum type alloy with a whisker or fiber of a material having high strength and elasticity, such as silicon carbide, silicon nitride, carbon, alumina or potassium hexatitanate, as a whisker or reinforcer, and as the composite-forming method, there are known a hot press method, a HIP method, an infiltration method, a powder metallurgy method, a high-pressure casting case method and a hot extrusion method.

In the production of an aluminum type metal-based composite material, it is important that a reinforcing whisker or fiber should have a high wettability with and be inert to a melt of aluminum. However, reinforcers having such properties are limited in number and most of whiskers and fibers are practically used in the state where the surface is coated with an inert compound.

Among these reinforcers, an alumina type fiber or whisker and a silicon carbide whisker satisfy the above-mentioned two-requirements and are promising as a reinforcing material. However, since they are expensive, they can hardly be applied to general-purpose uses for automobiles, construction materials and the like, though they may be used in the aerospace industry.

At the present, from the economical viewpoint, only a whisker of potassium hexatitanate can be used as a general-purpose reinforcer for the production of an aluminum type metal composite material. However, this compound has an inherent problem in that tetravalent titanium is reduced with metallic aluminum and an intermetallic compound such as $Ti_3Al$ is formed.

Accordingly, this reducing reaction is controlled by shortening the heat treatment time to the utmost, but in this case, the process becomes defective in that no satisfactory composite effect can be attained.

SUMMARY OF THE INVENTION

It is a primary object of the present invention to solve the foregoing problems and provide a whisker-reinforced aluminum type metal-based composite material in which a sufficient reinforcing effect is attained by using a cheap reinforcing material not reactive with a matrix metal and a process for the preparation of this composite material.

Under the above-mentioned background, we made research, and as the result, we found that an aluminum type metal-based composite material obtained by combining aluminum or an aluminum alloy with a whisker of an aluminum borate represened by the chemical formula of $9Al_2O_3 .2B_2O_3$ or $2Al_2O_3.B_2O_3$ has improved mechanical properties such as high tensile strength and hardness. We have now completed the present invention based on this finding.

More specifically, in accordance with one aspect of the present invention, there is provided a metal-based composite material which comprises aluminum or an aluminum alloy combined with an aluminum borate whisker.

In accordance with another aspect of the present invention, there is provided a process for the preparation of a metal-based composite material, which comprises mixing a powder of aluminum or an aluminum alloy with an aluminum borate whisker, pressure-molding the mixture and firing the molded body.

In accordance with still another aspect of the present invention, there is provided a process for the preparation of a metal-based composite material, which comprises mixing a powder of aluminum or an aluminum alloy with an aluminum borate whisker and firing the mixture under compression.

In accordance with still another aspect of the present invention, there is provided a process for the preparation of a metal-based composite material, which comprises infiltrating a pre-formed body of an aluminum borate whisker with a melt of aluminum or an aluminum alloy.

DETAILED DESCRIPTION OF THE PREFERRED EMBODIMENTS

The aluminum borate whisker used in the present invention is a compound prepared according to the process disclosed in Japanese Unexamined Patent Publication No. 63-319298 and Japanese Unexamined Patent Publication NO. 63-31 9299. Namely, the aluminum borate whisker can be prepared according to the liquid phase process comprising reacting at least one aluminumsupplying component selected from inorganic aluminum salts with at least one boric acid-supplying component selected from oxides and oxyacids of boron and alkali metal salts of boric acid in the presence of at least one flux selected from alkali metal chlorides, sulfates and carbonates at an elevated temperature of 900° to 1200° C. for $9Al_2O_3 .2B_2O_3$ or 600° to 1000° C. for $2Al_2O_3.B_2O_3$ and growing the reaction product.

Expensive whiskers are mainly prepared by the gas phase process requiring a high technique. In contrast, the whisker used in the present invention can be easily prepared according to the liquid phase process using a flux, and therefore, the whisker can be supplied at a low cost.

One means for preparing the metal-based composite material of the present invention is a process comprising mixing a powder of aluminum or an aluminum alloy with an aluminum borate whisker, pressure-molding the mixture and firing the molded body.

In practicing this process of the present invention, the particle size of the aluminum or aluminum alloy powder used as the matrix is smaller than 50 $\mu$m, preferably smaller than 20 $\mu$m, and a powder having a much reduced degree of the oxidation of the surface is suitable from the viewpoint of the sintering property.

Typical instances of the aluminum borate whisker are represented by chemical formulae of $9Al_2O_3$—.$2B_2O_3$ and $2Al_2O_3.B_2O_3$. The dimensions of the aluminum borate whisker are such that the fiber diameter is 0.05 to 10 μm, preferably 0.5 to 5 μm, and the length is 2 to 500 μm, preferably 5 to 200 μm. An aluminum borate whisker having none of aggregates such as pills and being disentangled is preferably used.

It is preferred that the amount of the whisker added to the aluminum or aluminum alloy be 5 to 40% by volume. If the amount of the whisker is too small, no sufficient reinforcing effect is attained, and if the amount of the whisker is too large, the compatibility of the whisker with the aluminum or aluminum alloy in the interface thereof is insufficient and no satisfactory reinforcing effect can be attained.

In carrying out the process of the present invention, the compatibility of the whisker with the aluminum type metal is preferably increased by spreading lithium hydroxide on the surface of the aluminum borate whisker. This spreading can be accomplished by immersing the whisker in a solution containing lithium hydroxide dissolved therein and drying the whisker.

A mixture comprising 5 to 40% by volume of the aluminum borate whisker dispersed in the powdery aluminum or aluminum alloy is pressure-molded at normal temperature under a pressure of 5 to 20 ton/cm$^2$, and the molded body is sintered at a temperature of 500° to 650° C., preferably 580° to 630° C. under atmospheric pressure in an inert gas such as nitrogen or argon or a reducing atmosphere such as hydrogen over a period of 5 minutes to 2 hours to obtain an intended aluminum type metal-based composite material.

Uniform and homogeneous mixing of the aluminum borate whisker with the aluminum or aluminum alloy is not sufficiently attained by dry blending, and wet blending using a solvent is preferably adopted. A polar solvent is preferably used for this purpose, and an alcohol is most preferably used.

Predetermined amounts of the aluminum or aluminum alloy powder and the aluminum borate whisker are added to the solvent and they are uniformly dispersed in the solvent by irradiation with ultrasonic vibrations. The ratio of the solids to the solvent is adjusted to 3 to 30% by volume. As the means for obtaining a dry mixture by removing the solvent from the obtained slurry, there can be adopted a method in which the slurry is promptly subjected to suction filtration and the remaining solid is dried, or a method in which the slurry is subjected to evaporation to dryness while keeping the dispersion state.

As another means for preparing the metal-based composite material of the present invention, there can be mentioned a process comprising mixing a powder of aluminum or an aluminum alloy with an aluminum borate whisker and firing the mixture under pressure.

In carrying out this process of the present invention, the aluminum or aluminum alloy powder is mixed with the aluminum borate whisker in the same manner as described above, and the mixed powder is charged in a mold and heated and sintered at a temperature in the range of from 500° to 650° C. in vacuo for 5 minutes to 2 hours under pressurization to 500 to 5000 kgf/cm$^2$, whereby an intended composite material can be obtained.

Furthermore, the composite material can be prepared by filling and sealing the starting powder mixture in an iron or glass capsule in vacuo, and heating and sintering the mixture at a temperature of 500° to 650° C. for 5 minutes to 2 hours while isotropically compressing the capsule under a pressure of 500 to 5000 kgf/cm$^2$ by an inert gas.

In carrying out this process, it is preferred that the surface of the aluminum borate whisker be coated with a vinyl silane so as to increase the compatibility with the aluminum type metal. As the means for coating the surface of the aluminum borate whisker with a vinyl silane, there can be adopted a method comprising contacting the whisker with the vapor of the vinyl silane, a method mixing the vinyl silane and whisker in the slurry state, and a method comprising spraying the vinyl silane on the whisker. As the solvent for dispersing the whisker surface-coated with the vinyl silane in the aluminum type metal powder, nonpolar solvents such as hexane and benzene are preferably used.

Incidentally, in the case where the vinyl silane-treated whisker is sealed in a capsule, it is necessary that the sealing should be effected after the vinyl silane is completely decomposed and removed by heating in vacuo at a temperature of about 500° C.

Still another means for preparing the metal-based composite material of the present invention is a process comprising infiltrating a molded body of an aluminum borate whisker with aluminum or an aluminum alloy.

In practicing this process of the present invention, an aluminum borate whisker molded body shaped into an appropriate form in advance is contacted with a melt of aluminum or an aluminum alloy under a pressure of 50 to 2000 kgf/cm$^2$ to obtain an intended metal-based composite material.

Embodiments of this process of the present invention will now be described.

As the aluminum and aluminum alloy as the matrix, there can be used those customarily used as spreading casting materials. Aluminum borate whiskers as described above are preferably used.

For forming the molded body of the whisker, at first, a slurry is prepared by using water as the dispersant. The whisker concentration in the slurry is adjusted to 3 to 40% by weight, and an organic binder and an inorganic binder are added to the slurry in amounts of 0.1 to 20% by weight and 0.01 to 5% by weight, respectively, based on the binder. The slurry should be uniformalized by mechanical stirring or irradiation with ultrasonic waves so that the whisker is disentangled into individual filaments.

Water-soluble or hydrophilic organic and inorganic binders are used. More specifically, an alginic acid salt, sugar, molasses, a cellulose ether, polyvinyl alcohol and carboxymethyl cellulose are preferably used as the organic binder, and water glass, silica sol and alumina sol are preferably used as the inorganic binder.

The prepared aluminum borate whisker slurry is concentrated to produce a semi-dry state where the water content is about 1 to about 10%. The semi-dried dispersion is placed in a mold designed to have a predetermined shape and pressure molding is carried out. At this step, the organic binder exerts a function of improving the moldability.

The molded body is dried at 100° to 200° C. to gel the inorganic binder, and in order to increase the mechanical strength of the molded body to a level capable of resisting the pressure to be applied at the melt forging step, the molded body is fired at 500° to 1000° C.

By this firing, all of the organic binder is burnt away completely.

The so-prepared molded body of the whisker is placed in a mold designed to have a predetermined shape, and a predetermined amount of a melt of aluminum or an aluminum alloy is cast into the mold. Compression is effected by a punch located above to cause the melt to permeate into spaces in the whisker molded body, followed by cooling, whereby an intended composite body is obtained.

The pressure for permeation of the melt is 50 to 2000 kg/cm$^2$, the mold temperature is 200° to 500° C., the melt temperature is 700° to 900° C., and the temperature of the whisker molded body is preferably almost equal to the melt temperature.

If the mold temperature is too high, the coagulation speed of the melt becomes low and the productivity is reduced, though a product having better performances can be obtained. In contrast, if the mold temperature is low, the coagulation of the whisker molded body and melt becomes too high and the permeation becomes insufficient. For similar reasons, it is necessary that the whisker molded body should be sufficiently preheated.

The aluminum borate whisker has a high strength, a high elasticity and a high melting point and contains a large amount of the alumina component in the compound. The chemical properties of the aluminum borate whisker are, therefore, similar to those of an alumina fiber and the affinity with aluminum is good. Accordingly, if the aluminum borate whisker is combined with aluminum or an aluminum alloy, the aluminum type metal is intimately and uniformly mixed with the borate aluminum whisker, and it is considered that for this reason, an excellent strength is manifested in the composite body.

When the aluminum type metal composite body of the present invention is examined by the X-ray diffractometry or under a scanning type electron microscope, it is confirmed that the aluminum borate whisker is not reacted with the aluminum or aluminum alloy as the matrix at all. When a test piece is cut out from the composite body and the mechanical strength is measured, it is confirmed that a sufficient reinforcing effect by the whisker is manifested. Thus, it is proved that the present invention is very effective.

The composite material of the present invention can be formed into a final product by a heat treatment, a hot extrusion using a die or a machining operation.

The present invention will now be described in detail with reference to the following examples and comparative examples.

EXAMPLE 1

A beaker was charged with ethyl alcohol, and 3.1 g of a whisker of $9Al_2O_3.2B_2O_3$ having a diameter of about 1 μm and a length of 10 to 30 μm and 12.2 g of a pure aluminum powder having a particle size smaller than 20 μm (the content of the whisker was about 20% by volume) were added into the beaker. The mixture was irradiated with ultrasonic waves for 20 minutes and was promptly subjected to suction filtration. The solids were dried to form a sample for the pressure molding. The sample was placed in a mold having a diameter of 20 mm, and the sample was pressed under a total pressure of 30 tons while maintaining vacuum within the mold by suction, whereby a molded body having a height of about 10 mm was formed.

The molded body was placed in an alumina boat and maintained at 620° C. for 20 minutes in a nitrogen atmosphere, and the body was cooled to room temperature over a period of about 1 hour. The obtained fired composite body was machined by an emery cutter and a lathe to obtain test pieces for the tensile test and the measurement of the hardness, and the physical properties were examined. It was found that the tensile strength was 14 kgf/mm$^2$ and the micro Vickers hardness under a load of 0.2 kg was 75.

The fired body prepared in the same manner as described above without addition of the whisker of $9Al_2O_3.2B_2O_3$ had a tensile strength of 9 kgf/mm$^2$ and a micro Vickers hardness of 34 under a load of 0.2 kgf.

EXAMPLE 2

A beaker was charged with 0.17 g of $LiOH.2H_2O$ and 100 cc of ethyl alcohol, and a homogeneous solution was prepared. Then, a whisker of $9Al_2O_3.2B_2O_3$ having a diameter of about 1 μm and a length of 10 to 30 μm and 12.2 g of a pure aluminum powder having a particle size smaller than 20 μm (the content of the whisker was about 20% by volume) were added into the solution and the mixture was irradiated with ultrasonic waves for about 20 minutes. The alcohol was removed by a rotary evaporator to obtain a sample for the pressure molding. The subsequent treatments were carried out in the same manner as described in Example 1. The tensile strength of the obtained composite body was 20 kgf/mm$^2$.

EXAMPLE 3

A composite body was prepared in the same manner as described in Example 2 except that the amount of $LiOH.2H_2O$ was changed to 0.08 g, the amount of $9Al_2O_3.2B_2O_3$ was changed to 1.5 g and the amount of the pure aluminum powder was changed to 13.8 g (the content of the whisker was about 10% by volume). The tensile strength of the composite body was 13 kgf/mm$^2$ and the micro Vickers hardness under a load of 0.2 kg was 55.

EXAMPLE 4

A composite body was prepared in the same manner as described in Example 2 except that the amount of $LiOH.2H_2O$ was changed to 0.25 g, the amount of $9Al_2O_3.2B_2O_3$ was changed to 4.6 g and the amount of the pure aluminum powder was changed to 10.7 g (the content of the whisker was about 30% by volume). The tensile strength of the composite body was 24 kgf/mm$^2$, and the micro Vickers hardness under a load of 0.2 kg was 110.

EXAMPLE 5

A beaker was charged with 0.10 g of $LiOH.2H_2O$ and 100 cc of ethyl alcohol, and a homogeneous solution was prepared. Then, 3.1 g of a whisker of $2Al_2O_3.B_2O_3$ having a diameter of about 0.5 μm and a length of 5 to 15 m and 12.2 g of a pure aluminum powder having a particle size smaller than 20 μm (the content of the whisker was about 20% by volume) were added to the solution and the mixture was irradiated with ultrasonic waves for 20 minutes. The alcohol was removed by a rotary evaporator to obtain a sample for the pressure molding. The subsequent treatments were carried out in the same manner as described in Example 1. The tensile strength of the obtained composite body was 18 kgf/mm$^2$.

EXAMPLE 6

A beaker was charged with 0.12 g of $LiOH.2H_2O$ and 100 cc of ethyl alcohol, and a homogeneous solution was prepared. Then, 3.1 g of a whisker of $9Al_2O_3$ $.2B_2O_3$ having a diameter of about 1 μm and a length of 10 to 30 μm and 12.2 g of an Al-Si-Mg alloy powder [ISO: Al-Si7Mg(Fe)] having a particle size smaller than 44 μm (the content of the whisker was about 20% by volume) were added to the solution. The mixture was irradiated with ultrasonic waves for 20 minutes and the alcohol was removed by a rotary evaporator to obtain a sample for the pressure molding.

The sample was charged in a mold having a diameter of 8 mm and was pressed under a total pressure of 5 tons while producing vacuum within the mold by suction to prepare a molded body having a height of about 20 mm. The molded body was placed in an alumina boat and maintained at 630° C. for 60 minutes in a hydrogen atmosphere. The body was cooled to room temperature over a period of about 1 hour and the subsequent treatments were carried out in the same manner as described in Example 1. The tensile strength of the obtained composite body was 28 kgf/mm$^2$.

The fired body formed in the same manner as described above without adding the whisker of $9Al_2O_3$—$.2B_2O_3$ had a tensile strength of 18 kg/m$^2$.

EXAMPLE 7

A beaker was charged with 200 cc of ethyl alcohol, and 9.3 g of a whisker of $9Al_2O_3.2B_2O_3$ having a diameter of about 1 μm and a length of 10 to 30 μm and 36.6 g of a pure aluminum powder having a particle size smaller than 50 μm (the content of the whisker was about 20% by volume) were added to the alcohol. The mixture was irradiated with ultrasonic waves for 20 minutes and promptly subjected to suction filtration. The solids were dried to form a sample for the pressure sintering. Then, the sample was placed in a mold having a diameter of 45 mm and pressed under a total pressure of 15 tons while producing vacuum within the mold by suction. The mold was heated to 650° C. and maintained at this temperature for 20 minutes to sinter the starting mixture. The mold was cooled and the pressure was returned to atmospheric pressure, and the fired composite body was taken out from the mold and machined by an emery cutter and a lathe to prepare test pieces for the tensile test and the measurement of the hardness. The physical properties of the test pieces were examined. It was found that the tensile strength was 18 kgf/mm$^2$ and the micro Vickers hardness under a load of 0.2 kg was 68.

In contrast, a fired body prepared in the same manner as described above witout addition of the whisker of $9Al_2O_3.2B_2O_3$ had a tensile strength of 9 kgf/mm$^2$ and a micro Vickers hardness under a load of 0.2 kgf of 38.

EXAMPLE 8

A glass tube having an outer diameter of 30 mm and a total length of 20 cm was filled with about 40 g of a whisker of $9Al_2O_32B_2O_3$ and heated at 80° C., and air saturated with the vapor of trimethoxyvinyl silane was passed through the tube at a rate of 500 cc/min for 1 hour at a temperature of 80° C. to cover the whisker with the vinyl silane. The treatments were carried out in the same manner as described in Example 7 except that this covered whisker was used and hexane was used as the dispersing solvent. The tensile strength of the fired body was 20 kgf/mm$^2$.

EXAMPLE 9

Four starting mixture slurries (the content of the whisker was about 20% by volume) were prepared by adding 5 g of a whisker of $9Al_2O_3.2B_2O_3$ having the surface treated with the vinyl silane in the same manner as described in Example 8 to 150 ml of hexane and further adding 20 g of each of four pure aluminum powders differing in the particle size, independently. Each slurry was stirred under irradiation with ultrasonic waves and poured into a suction filter device connected to a water stream pump. Immediately, the pressure was reduced to effect filtration. The obtained solids were dried and were uniformly and tightly filled in a drum-like Pyrex glass capsule having a diameter of 10 to 20 mm and a length of about 50 mm. Vacuum was produced within the capsule and the solids were maintained at a temperature of 500° C. for about 1 hour to decompose and remove the vinyl silane. The vacuum line-connecting portion of the capsule was cut and fusion-sealed by a burner. Each of the so-prepared treatment capsules was set in a hot isotropic pressurization (HIP) apparatus, and the temperature was elevated to 1000 kgf/cm$^2$ in a capsule-filled chamber heated at 630° C. and this state was maintained for 1 hour to effect sintering. The temperature and pressure were lowered to normal levels over a period of 1 hour. The composite body was taken out from the capsule and test pieces were cut out from the composite body by using an emery cutter and a lathe. The tensile strength and micro Vickers hardness were measured in the same manner as in the foregoing examples.

The obtained results are shown in Table 1. As the particle size of the aluminum powder used was decreased, the tensile strength was improved.

TABLE 1

| Particle Size of Aluminum Powder | Tensile Strength (kgf/mm$^2$) | Micro Vickers Hardness |
|---|---|---|
| smaller than 200 μm | 19 | 116 |
| smaller than 100 μm | 21 | 68 |
| smaller than 40 μm | 23 | 77 |
| smaller than 5 μm | 26 | 75 |

EXAMPLE 10 AND COMPARATIVE EXAMPLE 1

A composite material was prepared in the same manner as described in Example 7 except that a pure aluminum powder having a particle size smaller than 5 μm was used and the whisker of $9Al_2O_3.2B_2O_3$ was added in an amount of 10, 20 or 30% by volume based on the entire mixture. The tensile strength and hardness of the test piece was measured. The obtained results are shown in Table 2.

For comparison, the above treatments were conducted in the same manner except that a potassium hexatitanate whisker (TISMO-D supplied by Otsuka Kagaku) was used instead of the $9Al_2O_3.2B_2O_3$ whisker. The tensile strength of the obtained composite material was measured. The obtained results are shown in Table 2.

TABLE 2

| | Example 10 Aluminum borate whisker | | Comparative Example 1 potassium hexatitanate whisker |
|---|---|---|---|
| Volume Ratio (%) of Whisker | Tensle strength (kgf/mm$^2$) | Micro Vickers Hardness | Tensile Strength (kgs/mm$^2$) |
| 0 | 11 | 34 | 11 |
| 10 | 21 | 56 | 13 |

TABLE 2-continued

| Volume Ratio (%) of Whisker | Example 10 Aluminum borate whisker Tensile strength (kgf/mm²) | Example 10 Aluminum borate whisker Micro Vickers Hardness | Comparative Example 1 potassium hexatitanate whisker Tensile Strength (kgs/mm²) |
|---|---|---|---|
| 20 | 26 | 75 | 16 |
| 30 | 28 | 115 | 17 |

EXAMPLE 11

A beaker was charged with 200 cc of hexane, and 9.3 g of a whisker of $2Al_2O_3.B_2O_3$ having a diameter of about 0.6 μm and a length of 10 to 20 μm and 36.6 g of an aluminum-magnesium alloy powder having a particle size smaller than 50 μm (the content of the whisker was about 20% by volume) were added into the beaker. The mixture was irradiated with ultrasonic waves for 20 minutes and promptly subjected to suction filtration, and the obtained solids were dried to prepare a sample for the pressure sintering. The sample was placed in a mold having a diameter of 45 mm and pressed under a total pressure of 20 tons while producing vacuum within the mold by suction. The mold was heated to 620° C. and maintained at this temperature for 30 minutes to sinter the starting material mixture. The subsequent treatments were carried out in the same manner as described in Example 7 to obtain test pieces. When the physical properties were measured, it was found that the tensile strength was 34 kgf/mm² and the micro Vickers hardness under a load of 0.2 kg was 75.

In contrast, a fired body prepared in the same manner as described above without addition of the $2Al_2O_3.B_2O_3$ whisker had a tensile strength of 28 kgf/mm² and a micro Vickers hardness under a load of 0.2 kgf of 45.

EXAMPLE 12 AND COMPARATIVE EXAMPLES 2 THROUGH 5

In 1 l of water was dispersed 100 g of a whisker of $9Al_2O_3.2B_2O_3$ having a diameter of about 1 μm and a length of 10 to 30 μm, and 5 g of polyvinyl alcohol and 4 cc of a 30% aqueous solution of silica sol were added to the dispersion. The mixture was irradiated with ultrasonic waves for 20 minutes to obtain a uniformly dispersed slurry.

The slurry was concentrated by a rotary evaporator so that the water content was reduced to about 10%. The concentrate was taken out and placed in a polyvinyl chloride mold having a cylindrical shape having an inner diameter of 10 cm. The charged concentrate was compressed by a piston of polyvinyl chloride so that the height of the content was reduced to 2 cm. The obtained molded body was removed from the mold, dried at 150° C. for 2 hours and fired at 800° C. for 1 hour to gel the silica sol and obtain a molded body in which the volume fraction (VF) of the whisker was 20%.

The as-fired hot molded body was placed in the central portion of the bottom of a mold having a cylindrical shape having an inner diameter of 12 cm, which was maintained at a temperature of 300° C., and about 200 cc of a aluminum alloy spreading material (ISO: A Mg1SiCu) melted at 800° C. was cast into the mold and promptly pressed by a piston arranged above the mold to cause the melted aluminum alloy to permeate into the molded body. The pressure adopted was 800 kg/cm². Since the permeation of the melt and the coagulation of the melt were completed within about 1 minute, the formed composite material was removed from the mold.

Then, the composite material was subjected to a solution treatment at 515° to 550° C. and then cooled with water. Then, the composite material was tempered at about 170° C. for 8 hours and test pieces (gauge length = 50 mm, parallel portion length = 60 mm, diameter = 14 mm) were cut out from the composite material. The tensile strength and the modulus of elasticity were measured.

The obtained results are shown in Table 3. As is seen from the results shown in Table 3, the strength of the aluminum whisker was sufficiently manifested.

For comparison, according to the above-mentioned procedures, composite materials having VF of 20% were prepared by using an alumina short fiber (ALCEN supplied by Denki Kagaku), potassium hexatitanate whisker (HT-300 supplied by Titan Kogyo), a silicon carbide whisker (supplied by Tateho Kagaku Kogyo) and a silicon nitride whisker (supplied by Tateho Kagaku Kogyo). The mechanical strength of each of these composite materials was measured. The obtained results are shown in Table 3.

As is apparent from the results shown in Table 3, the mechanical strength of each of the so-obtained composite materials, except the composite material prepared by using the silicon carbide whisker, was substantially lower than that of the composite material prepared by using the aluminum borate whisker.

Incidentally, since the silicon carbide whisker is much more expensive than the aluminum borate whisker, it is deemed that the aluminum borate whisker is superior as a general-purpose material.

TABLE 3

| | | Example 12 | Comparative Example No. 2 | 3 | 4 | 5 |
|---|---|---|---|---|---|---|
| Reinforcer | Kind | $9Al_2O_3 \cdot 2B_2O_3$ whisker | alumina short fiber | potassium hexatitanate | silicon carbide whisker | silicon nitride whisker |
| | Specific gravity | 2.93 | 3.30 | 3.30 | 3.18 | 3.18 |
| | VF (%) | 20 | 20 | 20 | 20 | 20 |
| | Amount (g) | 100 | 113 | 113 | 109 | 109 |
| Tensile Strength (kg/mm²) | | 45 | 31 | 31 | 44 | 42 |
| Young's Modulus (ton/mm²) | | 10.1 | 9.0 | 9.3 | 10.0 | 9.8 |

EXAMPLE 13

A molded body having VF of 20 or 30% was prepared in the same manner as described in Example 12 except that a whisker of $2Al_2O_3.B_2O_3$ having a diameter of about 0.5 μm and a length of 10 to 20 μm was used, carboxymethyl cellulose was added as the organic binder and alumina sol was added as the inorganic binder. Then, a composite material was prepare by using this molded body and an aluminum spreading material (ISO: A CU4SiMg) as the matrix alloy, and the composite material was quenched by water cooling at 495° to 505° C. After natural aging, the composite material was subjected to hot extrusion to obtain a wire rod having a diameter of 12 mm.

The mechanical properties of the composite material are shown in Table 4. From these results, it is seen that in the obtained composite material, the strength was sufficiently manifested.

TABLE 4

| Items | | Example 13 | | |
|---|---|---|---|---|
| Reinforcer | Kind | $9\ Al_2O_3 \cdot 2\ B_2O_3$ whisker | | not added |
| | VF (%) | 20 | 30 | 0 |
| | Amount (g) | 100 | 150 | 0 |
| Tensile Strength ($kg/mm^2$) | | 43 | 46 | 38 |
| Young's Modulus ($ton/mm^2$) | | 8.6 | 9.7 | 7.5 |

EXAMPLE 14

A molded body (VF=20%) of an aluminum borate whisker prepared in the same manner as described in Example 12 was treated in the same manner as described in Example 12 by using an aluminum cast material (ASTM: 336.0) as the aluminum alloy, whereby a composite material was obtained.

The obtained composite material was subjected to a solution treatment at a temperature of about 510° C. for 4 hours, annealed at a temperature of about 170° C. for 10 hours and allowed to stand still at a temperature of 25°, 200° or 300° C. for 100 hours, and the tensile strength was measured at the same temperature as the standing temperature.

For comparison, the aluminum cast material not combined with the whisker was allowed to stand still at the above-mentioned temperature for the above-mentioned time, and the tensile strength was measured at the same temperature.

The obtained results are shown in Table 5. From the results shown in Table 5, it is seen that the composite material prepared by using the aluminum borate whisker as the reinforcer had a much higher hot strength than that of the unreinforced material and the product obtained in this example was especially suitably used at a place where the product was exposed to a high temperature.

TABLE 5

| Items | Example 14 | | | | | |
|---|---|---|---|---|---|---|
| Whisker | added | | | not added | | |
| Tensile Strength Measurement Temperature (°C.) | 25 | 200 | 300 | 25 | 200 | 300 |
| Measured Value ($kg/mm^2$) | 46 | 30 | 24 | 30 | 18 | 8 |

We claim:

1. A process for the preparation of a metal-based composite material which comprises mixing a powder of aluminum or an aluminum alloy with an aluminum borate whisker, on the surface of which lithium hydroxide is spread, pressure-molding the mixture and firing the molded body.

2. A process for the preparation of a metal-based composite material which comprises mixing a powder of aluminum or an aluminum alloy with an aluminum borate whisker, the surface of which is covered with a vinyl silane, and firing the mixture under compression.

* * * * *